US007107873B2

(12) United States Patent
Barger

(10) Patent No.: US 7,107,873 B2
(45) Date of Patent: Sep. 19, 2006

(54) INKJET CARTRIDGE TOP REMOVER AND METHOD

(75) Inventor: Robert R. Barger, Valley Center, KS (US)

(73) Assignee: Stratitec Inc., Wichita, KS (US)

( * ) Notice: Subject to any disclaimer, the term of this patent is extended or adjusted under 35 U.S.C. 154(b) by 269 days.

(21) Appl. No.: 10/818,763

(22) Filed: Apr. 6, 2004

(65) Prior Publication Data

US 2005/0219331 A1 Oct. 6, 2005

(51) Int. Cl.
*B67B 7/62* (2006.01)
*B26F 3/02* (2006.01)

(52) U.S. Cl. ..... 81/3.37; 225/96.5; 225/103

(58) Field of Classification Search ..... 347/85, 347/86; 141/2, 18, 370, 375; 225/93, 96.5, 225/103; 81/3.37, 3.39, 3.55; 53/468
See application file for complete search history.

(56) References Cited

U.S. PATENT DOCUMENTS

| | | | | |
|---|---|---|---|---|
| 4,704,924 | A | 11/1987 | Echols | |
| 4,768,271 | A | 9/1988 | Jacob et al. | |
| 4,805,493 | A | 2/1989 | Stein | |
| 4,850,630 | A | 7/1989 | Davies | |
| 4,852,925 | A | 8/1989 | Lodin | |
| 5,031,485 | A | 7/1991 | Wu | |
| 5,199,470 | A | 4/1993 | Goldman | |
| 5,303,439 | A | 4/1994 | Seals | |
| 5,313,858 | A | 5/1994 | Stitt | |
| D350,270 | S | 9/1994 | Jensen | |
| 5,515,663 | A | 5/1996 | Allgeier, Sr. et al. | |
| 5,542,139 | A | 8/1996 | Boivin | |
| 5,546,830 | A | 8/1996 | Yuen | |
| 5,819,627 | A | 10/1998 | Hayao | |
| 5,838,352 | A | 11/1998 | Martinez | |
| 5,845,682 | A | 12/1998 | Hayao | |
| 5,857,509 | A | 1/1999 | Winefordner et al. | |
| D410,178 | S | 5/1999 | Clayson | |
| 5,906,143 | A | 5/1999 | Yuen | |
| D419,848 | S | 2/2000 | Kirby | |
| 6,062,107 | A | 5/2000 | Johnson | |
| D428,569 | S | 7/2000 | Miles | |
| 6,158,305 | A | 12/2000 | Slepickia | |
| D437,534 | S | 2/2001 | Gloden | |
| 6,196,665 | B1 * | 3/2001 | Weeks | 347/49 |
| 6,205,888 | B1 | 3/2001 | Laudani | |

(Continued)

*Primary Examiner*—Anh T. N. Vo
(74) *Attorney, Agent, or Firm*—Lathrop & Gage LC

(57) ABSTRACT

Disclosed is a device and method for removing the lid of an inkjet cartridge. The device holds the cartridge within two jaws, which secure only the bottom of the cartridge. A driving mechanism is used to pop off the top of the cartridge in order that it may be refilled. The driver is J-shaped and has long and short prongs connected by a cross member. A screw within a bulkhead is used to push the driver from the back. This causes the long prong to bear against the top of the cartridge to remove it. The short prong assists in guiding the driver. A spring pushes back on the driver the further it is driven. This enables the user to retract the driving member once the top of the cartridge has been removed. A shelf is formed on all of the jaws of the holder. One jaw has an overhang portion which, with the shelf, forms a channel. Many commercially available cartridges are configured with a rib at their midsection. The shelf and channel act to receive this rib so that the cartridge may be held securely. Also disclosed is a shim which is inserted into the device so that it may accommodate smaller-sized cartridges.

13 Claims, 8 Drawing Sheets

U.S. PATENT DOCUMENTS 6,263,761 B1 7/2001 Ryder
6,286,399 B1 9/2001 Ferster
6,349,869 B1 2/2002 McBee
6,401,571 B1 6/2002 Schuman
6,431,534 B1 8/2002 Orosz et al.
6,578,452 B1 6/2003 Dufly

* cited by examiner

INKJET CARTRIDGE TOP REMOVER AND METHOD

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

1. Field of the Invention

The device and method of the present invention relates to the general field of refilling inkjet cartridges. More specifically, the present invention relates to the forcible removal of an inkjet cartridge's lid using a mechanical device.

2. Description of the Related Art

There are several commercially-available varieties of computer printers. Some use thermal heads. Others use lasers. Perhaps the most common sort of printer, however, uses ink jets.

These inkjet printers are very popular because they may be purchased at relatively low cost. Maintenance is not quite so cheap, however. The print head and ink container for an inkjet printer is typically included in a disposable unit. These disposable units may be very expensive. In some cases, such a cartridge may be good for printing less than 500 sheets of paper, and cost more than a fourth of the purchase price for the printer in which they are to be used. Considering this, the user may quickly incur maintenance costs which exceed the cost of the entire printer.

One reason for the high cost per cartridge is that a new print head is included with the cartridge. This print head has a useful life multiple times longer than the length of time provided by the ink included. Therefore, when a cartridge is discarded after running out of ink, a still-good cartridge and print head are wasted.

The problem is exacerbated where color cartridges are concerned. Color cartridges typically have three separate color reservoirs. One for each of three primary colors. These colors will tend to run out at different rates. When the first of the three runs out, the user may throw out significant quantities of unused ink in the other two reservoirs.

The manufacturers of these cartridges have not provided the consumer with a way to replenish the ink within these cartridges, or even develop an alternative design in which does not require disposal of the cartridge. Instead, the manufacturers have created a cartridge that is difficult to refill. This type of cartridge typically has top and bottom shell-like halves. The top half typically has a flange created around its lower edges. The lower half has a flange around its upper edges. These flanges are fused together to connect the halves to create a fluidly sealed ink reservoir. The fusing is done through the use of adhesives or sonic welding. Because the fusion is intended by the manufacturer to be permanent, it difficult to break the halves apart for refilling without causing damage.

Devices have been developed in the prior art for separating the two halves. Most of these devices separate the halves using leverage. See e.g., U.S. Pat. No. 5,906,143 issued to Yuen. Other numerous devices exist which mechanically remove the cartridge top. All of the these prior art devices, however, have disadvantages. Many will damage the cartridge because of their crudeness. Others will not sufficiently grip the cartridge. This causes significant problems because the cartridge may pop out of its intended position, possibly exposing the user or his or her surroundings to be stained with permanent ink. The prior art devices may also not be capable of accommodating different sizes of cartridges.

Therefore, there exists in the art a need for a device that will enable the user to separate the two halves of a two-half cartridge so that it may be refilled with ink, but will not damage the cartridge, or cause the cartridges to pop out during the process. The device should also be versatile and accommodate different cartridge sizes.

SUMMARY OF THE INVENTION

The present invention satisfies these needs in the art by providing a device, and associated method for removing the lid of an inkjet cartridge which has a top portion with a flange on its lower edge, a bottom portion having a flange at its upper edge, and the flanges are joined together to form a rib. The device and method do not have the disadvantages stated above.

This is accomplished by using a holder to securely hold the bottom portion of the cartridge and slide a driving member to apply a force to said top portion of said cartridge to remove its top. The driver is substantially J-shaped, and has three portions: (i) a long prong, (ii) a cross member, and, (iii) a short prong. A screw is used to deliver a driving force to said cross member. This compels the long prong to engage the top of the cartridge. The short prong assists in guiding the member.

A spring is compressed between the cross member and an internal surface of a bulkhead portion of the holder to create an opposing force that enables the user to retract the driving member once the top of the cartridge has been removed.

The holder comprises two jaws connected by a midsection. A shelf is formed in one of the jaws, and a channel in the other. The rib on one side of the cartridge is accommodated by the shelf on one side of the cartridge, and in the annular channel on the other side of the cartridge. This shelf/channel arrangement enables the cartridge to be held securely so that the lid may be removed.

A shim is also disclosed. The shim is disposed between the jaws when a user wants to refill a smaller-sized cartridge. The shim has a tab on its back that is received by a notch in the midsection to hold the shim in position.

BRIEF DESCRIPTION OF THE SEVERAL VIEWS OF THE DRAWINGS

The present invention is described in detail below with reference to the attached drawing figures, wherein.

DETAILED DESCRIPTION OF THE INVENTION

Figure 1:
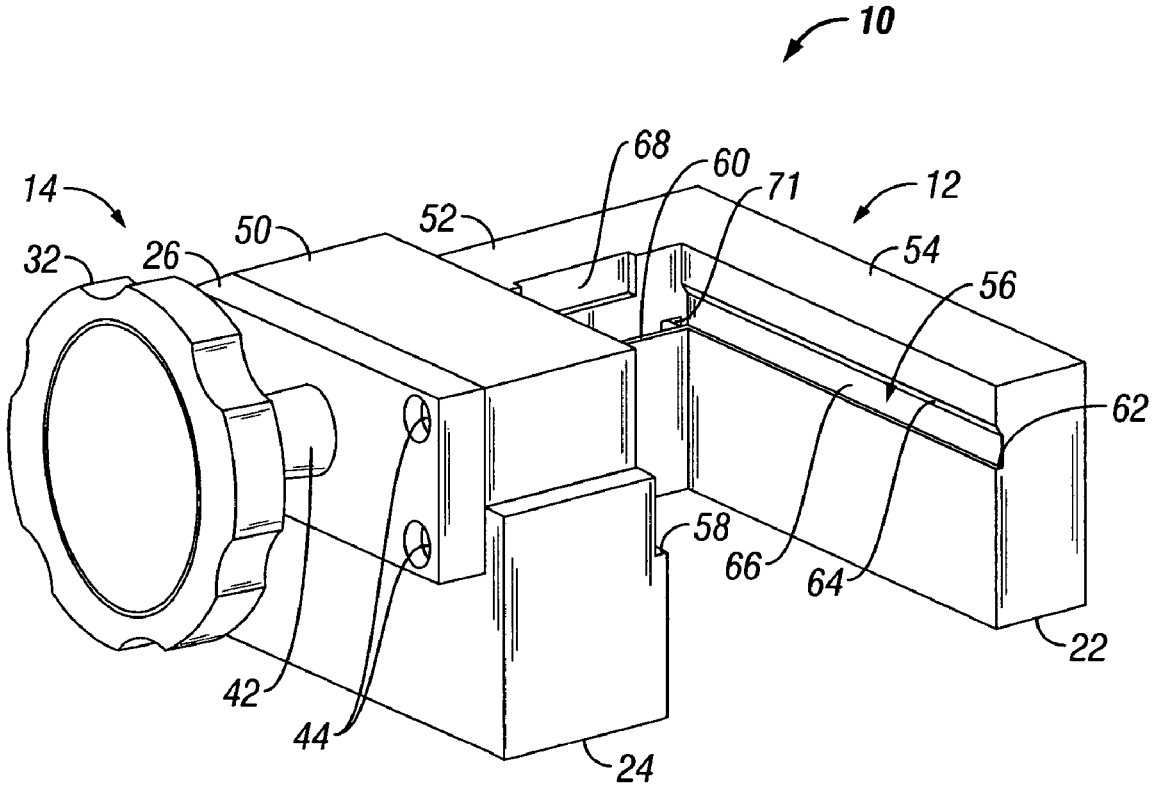
FIG. 1 is a perspective view of the device of the present invention viewed from the knob-side.

The inkjet's lid removal device is shown in FIGS. 1 through 9. Referring to these figures, device 10 comprises a holder 12, a driver assembly 14 with an actuating knob 32, and a cartridge 16.

Figure 2:
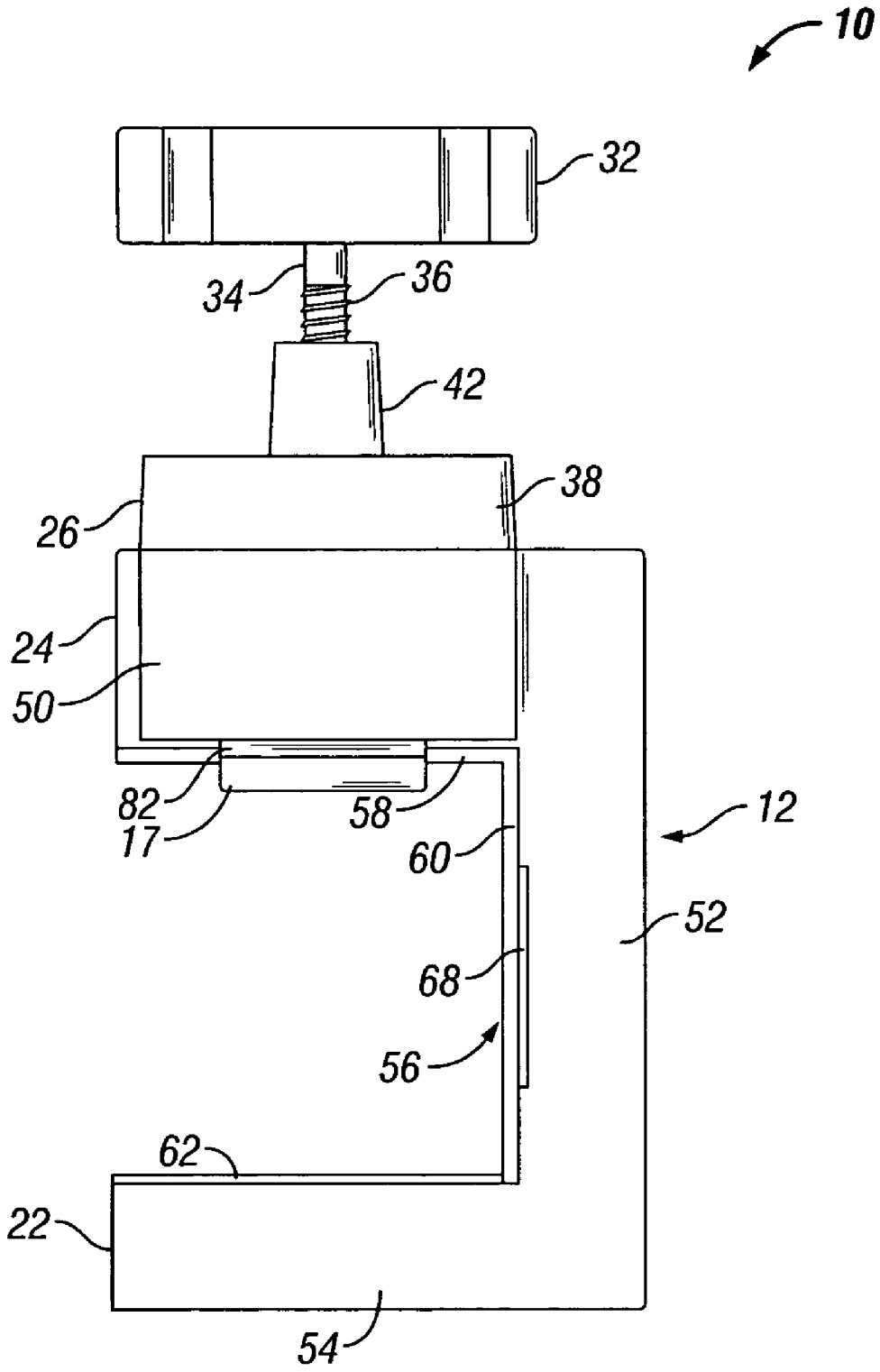
FIG. 2 is a top view of the device of the present invention.

The details regarding holder 12 may be seen in FIGS. 1 and 2. Referring to these figures, holder 12 comprises a first jaw 50 proximate knob 32, a midsection 52 and a second, distal jaw 54. Inscribed within each of jaws 50 and 54, and midsection 52, is a shelf 56 which is disposed across all three sections. A portion 58 of shelf 56 is on the same side of jaw 50 as knob 32. Another portion 60 of shelf 56 is disposed on midsection 52. Yet another portion 62 of shelf 56 is disposed on the second distal jaw 54. An overhang portion 64 on distal jaw 54 along with shelf 62 defines a channel 66. Portions 58 and 60 of the shelf do not have overhang portions. As will be described hereinafter, channel 66 is used to receive a protruding rib on the cartridge.

Figure 4:
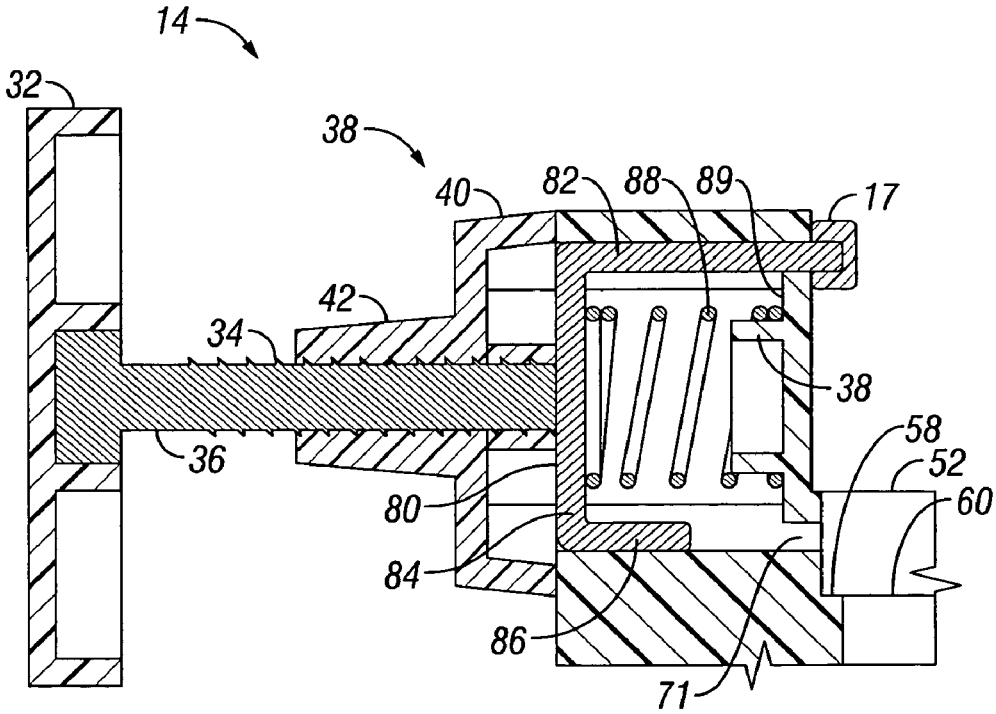
FIG. 4 is a breakaway drawing showing the internals of the driver assembly of the present invention.

The inside face of knob-side jaw 50 has a horizontally extending aperture 73. Referring to FIG. 4, aperture 73 is adapted to slidingly receive the short rectangular outwardly extending prong 86 of driving J 80 when driving J 80 is screwed into its innermost position. The short prong 86 helps the maintain the horizontal translation of driving J 80, as will be described hereinafter.

Figure 7:
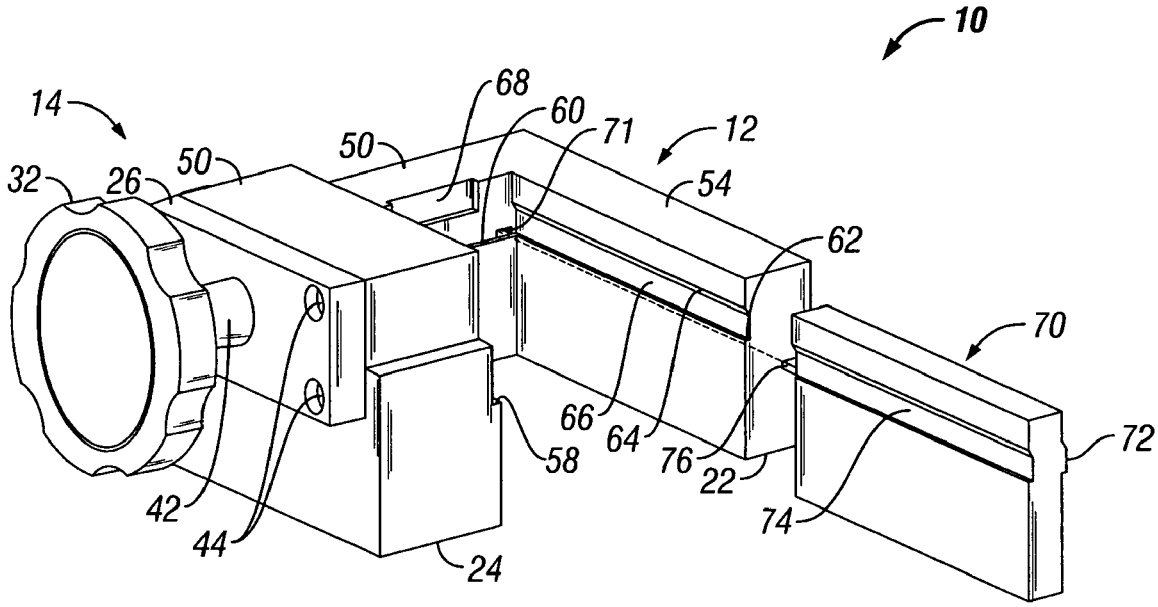
FIG. 7 is a perspective view of the device of the present invention showing how the spacer of the present invention may be inserted to accommodate smaller sized cartridges.
Figure 8:
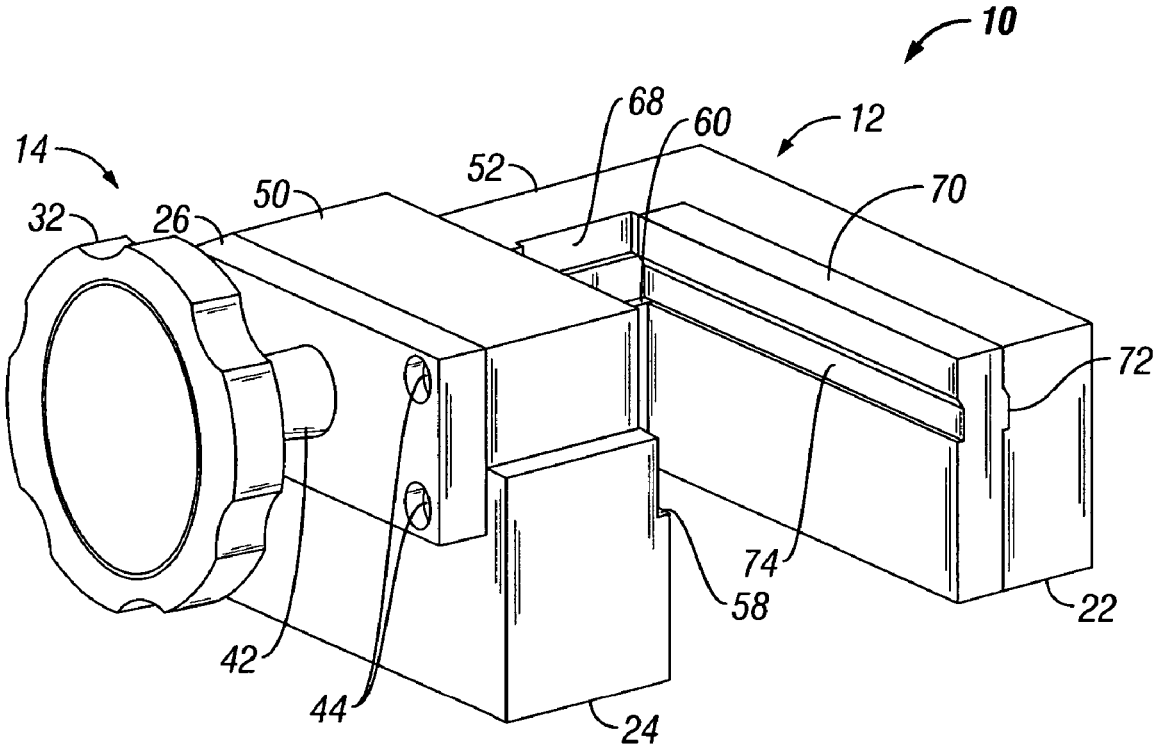
FIG. 8 is a perspective view of the device of the present invention after the spacer has been inserted therein.
Figure 9:
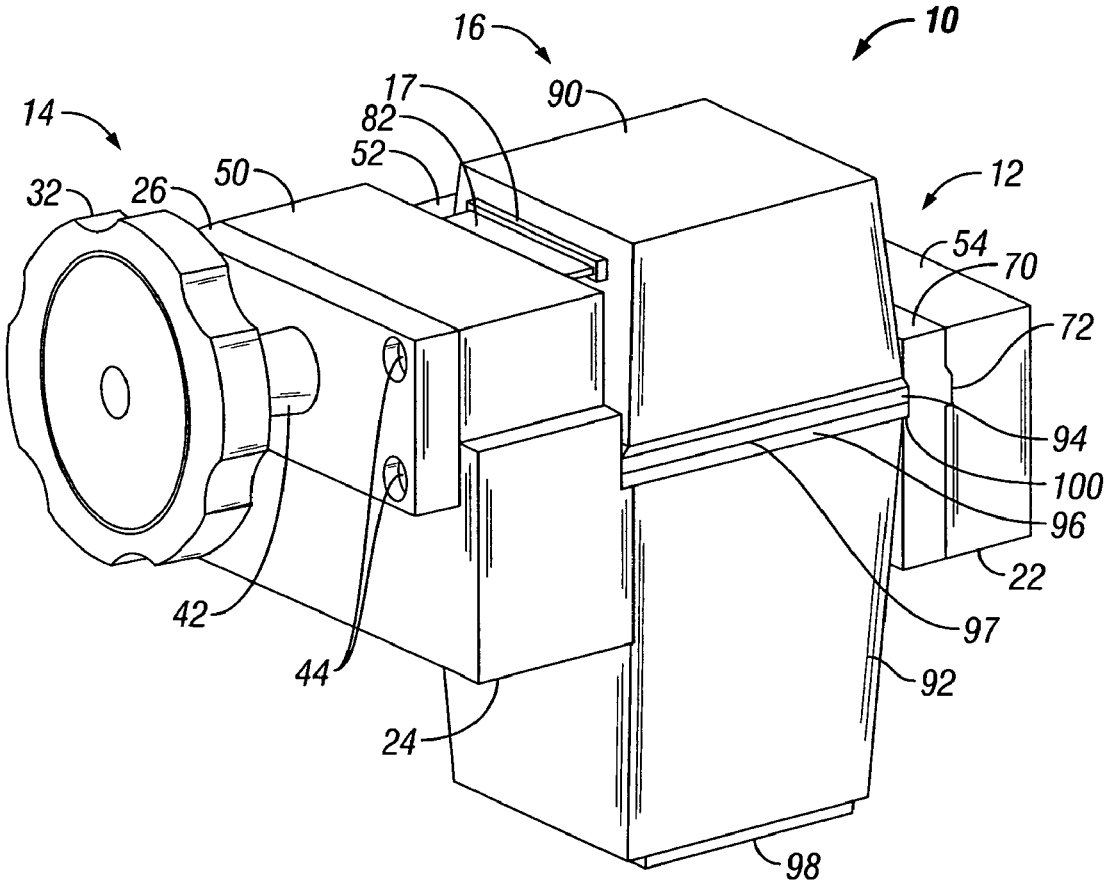
FIG. 9 is a perspective view showing the present invention using a spacer to remove the lid from a smaller size cartridge.

Also on holder 12 is a rectangular notch 71 in midsection 52 which serves to receive a reciprocating rectangular tab 76 on the backside of a slider shim 70, the details of which may be seen in FIGS. 7 and 8. FIG. 7 shows that slider shim 70 has an outside ridge 72 which is designed to be received by channel 66 on holder 12. Also on slider shim 70 is an inside channel 74. Channel 74 is, like channel 66, designed to receive a protruding ridge on cartridge 16. The purpose for shim 70 is to accommodate different sized cartridges. Rectangular tab 76 on its back, when received in notch 71, helps to lock it in place. Shim 70 becomes an inner-extending member having an inside surface which replicates the inside surface of distal jaw 54.

Figure 5:
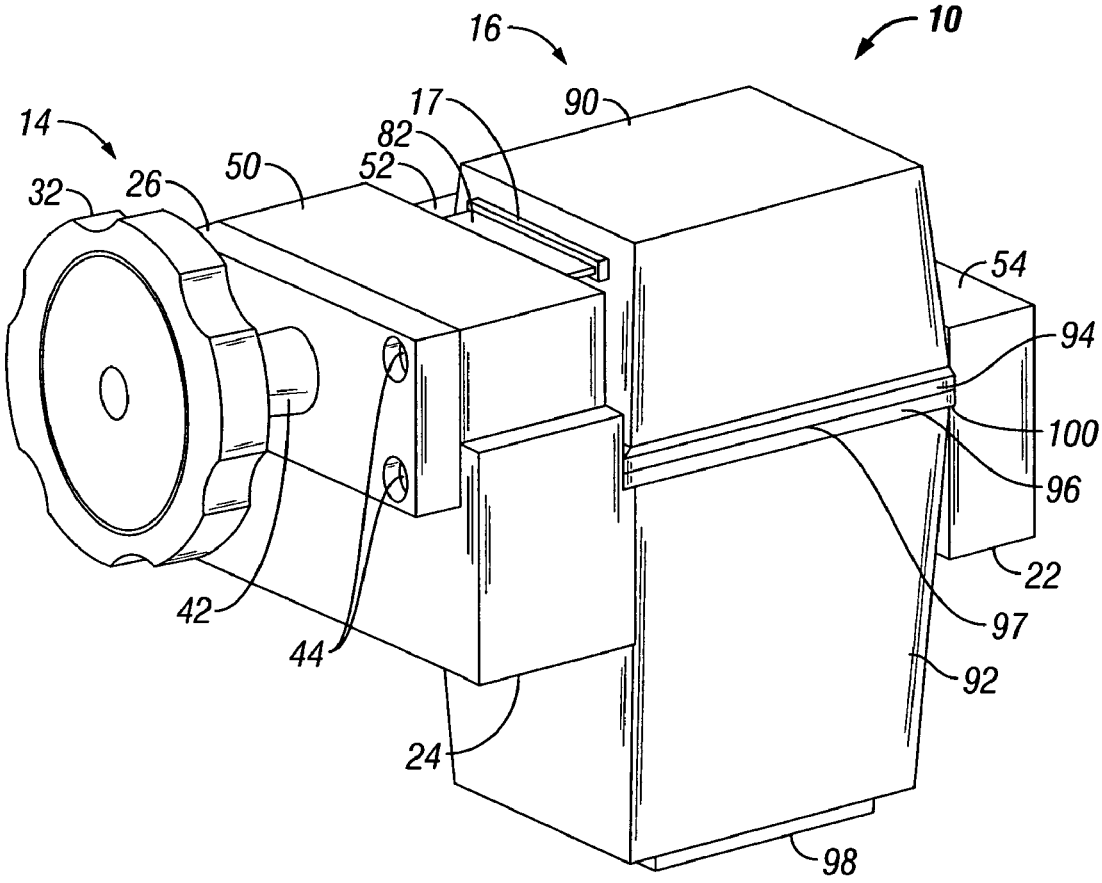
FIG. 5 is a perspective drawing of the device of the present invention being used to remove the top of an inkjet cartridge.
Figure 6:
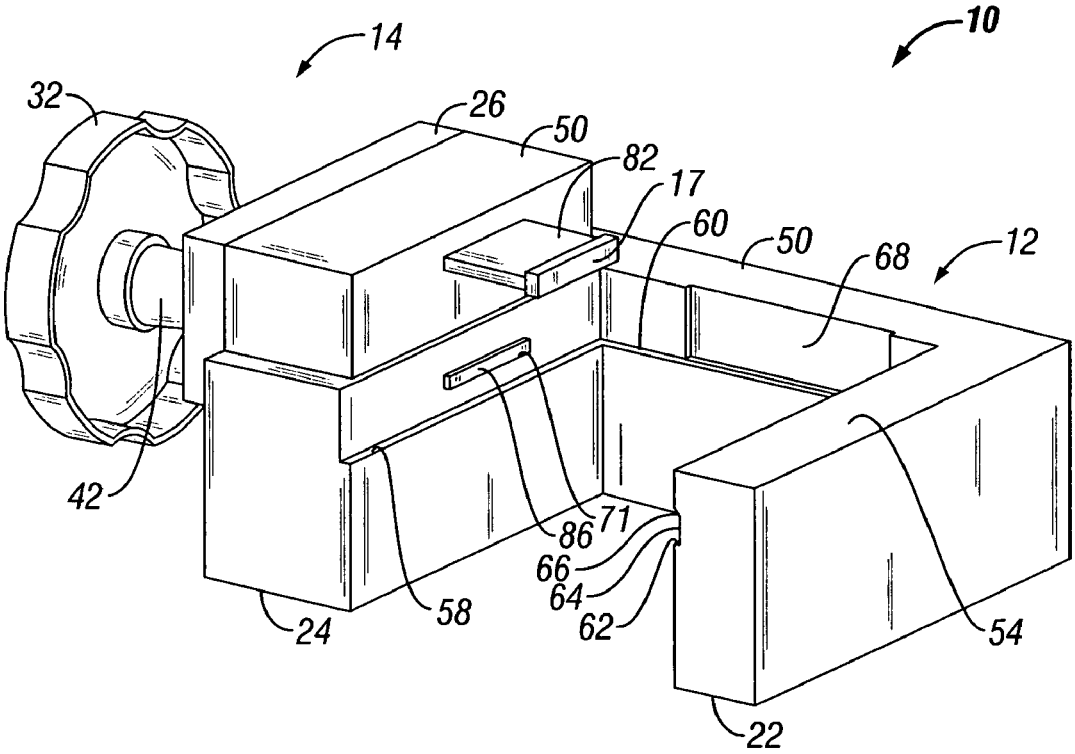
FIG. 6 is a perspective view of the device of the present invention viewed from opposite the knob side.

The cartridge shown in FIG. 5 is typical of those commercially available. Referring to the figure, cartridge 16 has a top portion 90, a bottom portion 92, an ink-port arrangement 98, and includes ink (typically maintained in a sponge-like device not pictured). Top portion 90 has a flange 94 formed about its lower edges. Bottom portion 92, similarly, has a top flange 96 which goes around its top edges and is designed to reciprocate with flange 94. When the cartridge is assembled by the manufacturer, flanges 94 and 96 are adhered together at a seam 97 to form a ridge 100. Ridge 100 protrudes around the entire periphery of the midsection of the cartridge. Ridge 100 is received by holder 12 to securely hold cartridge 16 in device 10 so that its lid may be removed by force, as will be described hereinafter.

A third major grouping of parts of device 10 are include within a driver assembly 14. Assembly 14 is best shown in the FIG. 4 breakaway illustration. FIG. 4 shows assembly 14 internally, whereas FIGS. 1 through 3 and 6 show its external features.

Figure 3:
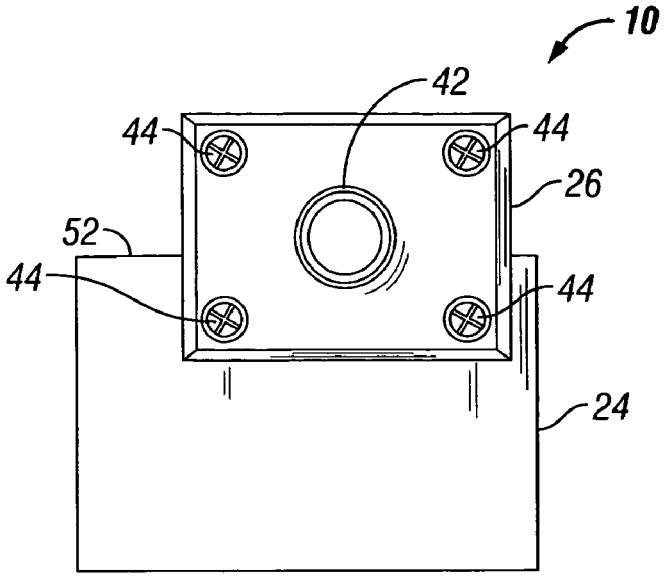
FIG. 3 is a knob-side view of the present invention with the knob removed.

With respect to its external features, driver assembly 14 has a knob 32 which is fixed to the end of a driving screw 34. Screw 34 has male threads 36 thereon. These mail threads 36 of screw 34 are received in female threads (not pictured) in a driver bulkhead 38 on holder 12. Bulkhead 38 has an outcropped portion 40. Further extending from outcropped portion 40 is an outwardly-extending-cylindrical section 42 which is tapered gradually inward as it extends out from portion 40. In FIG. 3, it may be seen that outcropped portion 40 is secured to holder 12 using four screws 44.

Now looking to the devices internal features shown in FIG. 4, we see that assembly 14 also comprises driving J 80, which was summarily discussed above, but will now be described here in further detail. Driving J 80 comprises a long prong 82, a cross member 84, and a short prong 86. A spring 88 is compressed between cross member 84 and an internal surface of the bulkhead 89. Long prong 82 has on its outer end a rubber engaging member 17 which is used to press against an outside surface of top portion 90 of cartridge 16. Short prong 86 is guided through horizontal longitudinal aperture 71. This provides guidance for driving J 80. The insides of bulkhead 38 are configured in such a manner that long prong 82 and short prong 86 are guided in a horizontal direction and so that long prong 82 along with rubber end 17 will engage the top portion of the cartridge. Short prong 86, however, does not. Meanwhile, spring 88 is compressed between cross member 84 and internal surface 89 of the bulkhead. Spring 88 is provided to create a countering force on cross member 84. This countering force increases (along with the compression of spring 88) the further screw 34 is driven into holder 12. This countering force is necessary in order that the driving J will be retractable from engagement with the cartridge 16 after the top 90 has been removed.

The process of the present invention will now be described in more detail. First, the cartridge desired to be refilled must be accommodated for size. This is done by using, or not using, slider shim 70. For larger sized cartridges, slider shim 70 will not be needed. For smaller sized cartridges, however, the use of shim 70 will be desirable so that the cartridge will be firmly held.

Slider shim 70 is easily installed in holder 12 when necessary to accommodate a smaller cartridge. This is done by sliding it within channel 66 in distal jaw 54 until rectangular tab 76 on the back of shim 74 is received in rectangular notch 71 in midsection 52. Once tab 76 is completely slid into notch 71, shim 70 will be in place (if necessary for smaller type cartridges).

Once shim 70 has been installed for smaller cartridges, or not installed for larger cartridges, it is time to insert cartridge 16. Before inserting the cartridge, however, screw 34 should be twisted outward using knob 32 until long prong 82 of driving J 80 is drawn into bulkhead 38 to the point that only rubber tip 17, and a slight bit of long prong 82 are visible extending outside the bulkhead.

The cartridge should then be slid into the holder 12. This is done by sliding the protruding rib of the cartridge on the knob side onto the shelf 58. Most of shelf 58 is unobstructed upward. Portion 62, however, has an overhang portion 64 which defines the upper restraint on channel 66. Thus, the protruding rib on one side of the cartridge must be slid into channel 66 (or channel 74 if slider shim 70 is used).

Once cartridge 16 has been slid all the way to the back of holder 12 to the extent that it engages midsection 52, it is time to begin the lid removal process. This is done by turning knob 32 in a clockwise direction. This causes male threads 36 on screw 34 to engage female threads (not pictured) in bulkhead 38. Drive screw 34 is, thus, forcibly driven against the outside of cross portion 84. This pushes driving J 80 towards cartridge 16. When this happens, long prong 82 with its rubber tip 81 will be driven towards, and engage the top of the cartridge 50. Short prong 86 does not engage any part of the cartridge 16 during the entire process. This is because short prong 86 is sized such that it is long enough to help maintain the driving J on course through bulkhead 38, but short enough that it never comes into contact with any part of cartridge 16.

Because cartridge 16 is held in place by, and in, holder 12, when its top 90 is engaged by tip 81 disposed on long prong 82, it is easily removed, or "popped off," so to speak, of the bottom portion 92 of cartridge 16.

Once top 90 has been removed, bottom portion 92 of cartridge 16 may be removed from the device (or not) and then filled as desired.

After cartridge 16 has been filled with ink, which is made possible by the lid being removed, the top 90 and bottom 92 are reattached using some form of adhesive, tape, or some other kind of binding and sealing means. Cartridge 16 is then ready to be returned to use.

Thus, there has been shown and described a device and method for removing the top of an inkjet cartridge, which fulfills all of the objects and advantages sought therefore. Many changes, modifications, variations, and other uses and applications of the subject invention will, however, become apparent to those skilled in the art after considering this specification together with the accompanying figures and claims.

The invention claimed is:

1. A device for opening an inkjet cartridge, said cartridge having top portion with a flange on a lower edge, a bottom portion having a flange at an upper edge, said flanges being bonded to one another and together forming a horizontal circumscribing rib, said device comprising:

a cartridge holder adapted to securely hold said bottom portion of said cartridge:

a slidable driving member which slides through a portion of said holder, and said driving member having a long prong for engaging said cartridge; a cross member for receiving a driving force; and a short prong for guiding said driving member said driving member serving to apply said force to said top portion of said cartridge to remove the top portion of said cartridge.

2. The device of claim 1 wherein said holder comprises a bulkhead for accommodating said driving member.

3. The device of claim 2, comprising: a screw which is screwed into said bulkhead to apply a driving force to one side of said cross member, said driving force compelling said driving member in a first direction towards said top portion of said cartridge.

4. The device of claim 3 comprising: a spring interposed between an opposite side of said cross member and an opposing surface within said bulkhead, said spring when compressed creating an opposing force compelling said member in a direction opposite said driving force.

5. A device for opening an inkjet cartridge, said cartridge having top portion with a flange on a lower edge, a bottom portion having a flange at an upper edge, said flanges being bonded to one another and together forming a horizontal circumscribing rib, said device comprising:

a cartridge holder having two opposing jaws wherein one of said opposing jaws has a shelf for accommodating the horizontal rib on one side of the cartridge, and the other of said opposing jaws has a channel into which the horizontal rib on an opposite side of said cartridge may be slid into and held to securely hold said bottom portion of said cartridge; and a slidable driving member for applying a force to said top portion of said cartridge to remove the top portion of said cartridge.

6. The device of claim 5 comprising: a shim which is placed between an inside surface of said other jaw, said shim accommodating for smaller cartridge sizes.

7. The device of claim 6 wherein said jaws are connected by a midsection, and where said shim has a tab on a back side which is received by a notch in said midsection which holds said shim in position.

8. A method of opening an ink jet cartridge, said cartridge having a top portion with a flange on a lower edge, a bottom portion having a flange at an upper edge, said flanges being bonded to one another and together forming a horizontal circumscribing rib, said method comprising:

securely holding said bottom portion of said cartridge in a holder;

providing a substantially J-shaped driving member, said driving member having a long prong, a cross member, and a short prong;

delivering a driving force to said cross member to compel said driving member towards said cartridge;

using said long and short prongs to guide said driving member through an aperture in said holder; and engaging the top portion of said cartridge with a distal end of said long prong to apply a force to said top portion of said cartridge to remove said top portion.

9. The method of claim 8 comprising: providing a bulkhead on said holder; rotating a screw into said bulkhead to engage one side of said cross member to deliver said driving force to said driving member.

10. The method of claim 9 comprising: interposing a spring between a side of said cross member opposite said one side of said cross member and an internal surface of said bulkhead to create an opposing force compelling said member in a direction opposite said driving force.

11. A method of opening an inkjet cartridge, said cartridge having a top portion with a flange on a lower edge, a bottom portion having a flange at an upper edge, said flanges being bonded to one another and together forming a horizontal circumscribing rib, said method comprising:

securely holding said bottom portion of said cartridge in a holder;

providing two opposing jaws on said holder; accommodating the horizontal rib on a first side of said cartridge on or above a shelf formed in one of said opposing jaws; forming a channel on the other of said opposing jaws; slidably receiving the horizontal rib on a second side of the cartridge in said channel into which the horizontal rib on an opposite side of said cartridge for the purpose of holding the cartridge securely; and sliding a driving member to apply a force to said top portion of said cartridge to remove said top portion.

12. The method of claim 11 comprising: using a shim to accommodate smaller sized cartridges in said holder.

13. The method of claim 12 comprising: connecting said jaws with a midsection; providing a tab on the back side of said shim; providing a notch in said midsection; sliding said tab into said notch to hold said shim in position.

* * * * *